US009908128B2

(12) United States Patent
Rech

(10) Patent No.: US 9,908,128 B2
(45) Date of Patent: Mar. 6, 2018

(54) SPRAYER FOR LIQUIDS WITH USD DEVICE THAT CAN BE USED ALSO IN HORIZONTAL POSITION

(71) Applicant: MWV-VICENZA S.p.a., Vicenza (IT)

(72) Inventor: Gilberto Rech, Vicenza (IT)

(73) Assignee: SILGAN DISPENSING SYSTEMS VINCENZA S.R.L., Romano D'Ezzelino (VI) (IT)

( * ) Notice: Subject to any disclaimer, the term of this patent is extended or adjusted under 35 U.S.C. 154(b) by 158 days.

(21) Appl. No.: 14/895,657

(22) PCT Filed: Jun. 10, 2014

(86) PCT No.: PCT/EP2014/061997
§ 371 (c)(1),
(2) Date: Dec. 3, 2015

(87) PCT Pub. No.: WO2014/198705
PCT Pub. Date: Dec. 18, 2014

(65) Prior Publication Data

US 2016/0136665 A1 May 19, 2016

(30) Foreign Application Priority Data

Jun. 13, 2013 (IT) ..... MI2013A0976

(51) Int. Cl.
*B67D 7/58* (2010.01)
*B05B 11/00* (2006.01)

(52) U.S. Cl.
CPC ..... *B05B 11/3012* (2013.01); *B05B 11/0059* (2013.01); *B05B 11/3011* (2013.01); *B05B 11/3064* (2013.01); *B05B 11/3066* (2013.01)

(58) Field of Classification Search
CPC ..... B05B 11/3012; B05B 11/0059; B05B 11/3066; B05B 11/3011; B05B 11/3064
(Continued)

(56) References Cited

U.S. PATENT DOCUMENTS 4,260,079 A * 4/1981 Cary ..... B05B 11/3035 222/209
4,310,107 A * 1/1982 Wesner ..... B05B 11/303 137/512

(Continued)

FOREIGN PATENT DOCUMENTS

JP 1999290732 A 10/1999

*Primary Examiner* — Jeremy W Carroll
(74) *Attorney, Agent, or Firm* — Barlow, Josephs & Holmes, Ltd.

(57) ABSTRACT

A sprayer for liquids (10) is disclosed with a trigger pump comprising a body (11) which can be applied to the mouth of a container and a liquid delivery nozzle, a pumping chamber (22) being formed in the body (11) which is in communication with the inside of the container and the delivery nozzle (16), through a one-way suction and delivery valve (30), a USD (Upside Down) device being provided rearward of said pumping chamber which allows operation of the sprayer in the upright and upside down position, consisting in a cylindrical chamber (40) closed at the top with a stopper (27) and having at its bottom a hole (44) in communication with said pumping chamber (22), shut off in the Up position by a ball (42) which, in the Down position, frees said hole (44) and slots (47) formed in the wall (46) of the chamber (40), putting the inside of the container into communication with the pumping chamber (42) through said slots (47) and said hole (44), said cylindrical chamber being slanted backwards so as to allow the operation of the sprayer also in horizontal position.

15 Claims, 6 Drawing Sheets

(58) Field of Classification Search
USPC ..... 222/383.1
See application file for complete search history.

(56) References Cited

U.S. PATENT DOCUMENTS

| | | | | |
|---|---|---|---|---|
| 4,365,751 | A * | 12/1982 | Saito | B05B 1/12 222/212 |
| 6,386,399 | B1 * | 5/2002 | Tsujii | B05B 11/0059 222/376 |
| 8,714,415 | B2 | 5/2014 | Rech et al. | |
| 2006/0054642 | A1 * | 3/2006 | Buti | B05B 11/3011 222/383.1 |
| 2011/0174843 | A1 * | 7/2011 | Rech | B05B 11/0059 222/376 |

* cited by examiner

SPRAYER FOR LIQUIDS WITH USD DEVICE THAT CAN BE USED ALSO IN HORIZONTAL POSITION

The present invention refers to a sprayer for liquids, in particular a pump sprayer operated manually by means of a trigger lever, with an integrated USD (upside down) device which allows delivery of the product even when the sprayer is in an upside-down position.

A sprayer generally comprises a main body provided with a base with a threaded ferrule or with a bayonet coupling to be applied to the mouth of a container for liquids, a delivery nozzle from which the liquid is sprayed, a trigger lever that can be manually operated by the user, and a pump that can be operated by the trigger lever to draw the liquid from the container by means of a dip tube and spray it through the delivery nozzle.

The pump has a piston acting in a chamber formed in the body of the sprayer. The body of the sprayer further comprises an inlet duct that puts the inside of the fluid container into communication with the pump chamber and an outlet duct that puts the pump chamber into communication with the sprayer nozzle. Within or immediately upstream of the pump chamber there is a fluid suction and delivery valve adapted to allow the fluid to be sucked selectively in a one-way manner from the container to the pump chamber and delivery of the fluid from the pump chamber towards the delivery nozzle.

A sprayer with a built-in USD device, to which the invention refers, allows dispensing of the liquid even in an upside-down position, that is, with the dip tube protruding beyond the liquid held in the container, when said container is in an upside-down position.

Examples of sprayers of this type are described for example in EP 968767 A1, EP 867229 A1 and WO 2006/101388 A1.

The sprayers described in the cited documents have two main drawbacks:

1. Numerous additional components are necessary for operation in an upright and upside-down position, with a consequent increase in the manufacturing cost of the sprayer;

2. A USD valve assembly is present in the area beneath the body of the sprayer which requires a dedicated filling and assembly line (container-product-sprayer), or else the dimensions of these sprayers in said area are such as to require often costly modifications to the filling lines already installed.

A sprayer with a USD device, that is, capable of operating even in an upside-down position, which allows to reduce the number of the components necessary to perform this function, and thus to limit the increases in the cost of the product is described in EP 2321063 in the name of the same Applicant.

However, the sprayer of said prior patent, as the conventional sprayers having or not having a USD function, uses a ball made of stainless steel, glass or plastic to obtain a valve sensitive to gravity, a ball which can move from its seat since it is not fixed, making thus impossible, after a few operations, the use of the sprayer in horizontal position for cleaning a wide surface such as a table. Indeed, as shown in the appended FIG. 1, when the sprayer is in horizontal position, the ball responsible for the USD functioning does not close tightly the horizontal channel which puts the inside of the container into communication with the pump chamber in up-side down position. Actually, as the ball does not seal it seat, the depression required to suck the liquid from the container through the dip tube is not created, neither the liquid can pass through the side apertures of the channel wherein the ball is placed when the container is horizontal, unless said container is fully filled. Accordingly, the sprayer does not work regularly, stopping to deliver liquid after some actuations.

The object of the invention is to eliminate the above drawback of the USD sprayers of the prior art.

Particularly, the object of the invention is to make the USD sprayers of EP 2321063 useable also in horizontal position.

The above object is achieved by the sprayer according to the invention which presents the features of appended independent claim 1.

Advantageous embodiments of the invention are set forth in the dependent claims.

Essentially, the sprayer according to the invention, which is structurally similar to that cited in EP 2321063 wherein there is provided, behind the pump body, a cavity or cylindrical chamber communicating at the bottom with the channel for sucking the liquid from the container through the dip tube, and having in its side wall slots which put it into communication with the inside of the container, is characterized in that said cylindrical chamber is slanted backwards with respect to the vertical axis of the sprayer.

Advantageously, the axis of the cylindrical chamber is slanted backwards with respect to the vertical axis of an angle ranging from 10 a 45°, preferably 25°.

Thereby, when the sprayer is placed horizontally in order to clean a plain horizontal surface, the ball disposed in the cylindrical chamber rests on the bottom thereof by gravity allowing the normal operation in the same way as the sprayer is upright in vertical position.

Theoretically, it exists a critical position where the sprayer according to the invention would fall in a situation comparable with the one wherein the sprayer of EP 2321063 is actuated in an horizontal position: it is the position where the slanted axis of the cylindrical chamber is horizontal, that is with the axis of the container slanted downwards of the same angle with respect to the vertical axis, and thus with the spray ferrule directed to the user. However it relates to a situation wherein a consumer would use very difficult the sprayer due to the poor comfortable and ineffective position for cleaning the plain surface. In any case, since the container is slanted downwards in said position, the liquid would tend to enter the pump chamber through the apertures which are provided on the sides of the cylindrical chamber, unless the liquid level is too low.

Further characteristics of the invention will be made clearer by the detailed description that follows, referring to a purely exemplary and therefore non limiting embodiment thereof, illustrated in the appended drawings, wherein.

Figure 1:
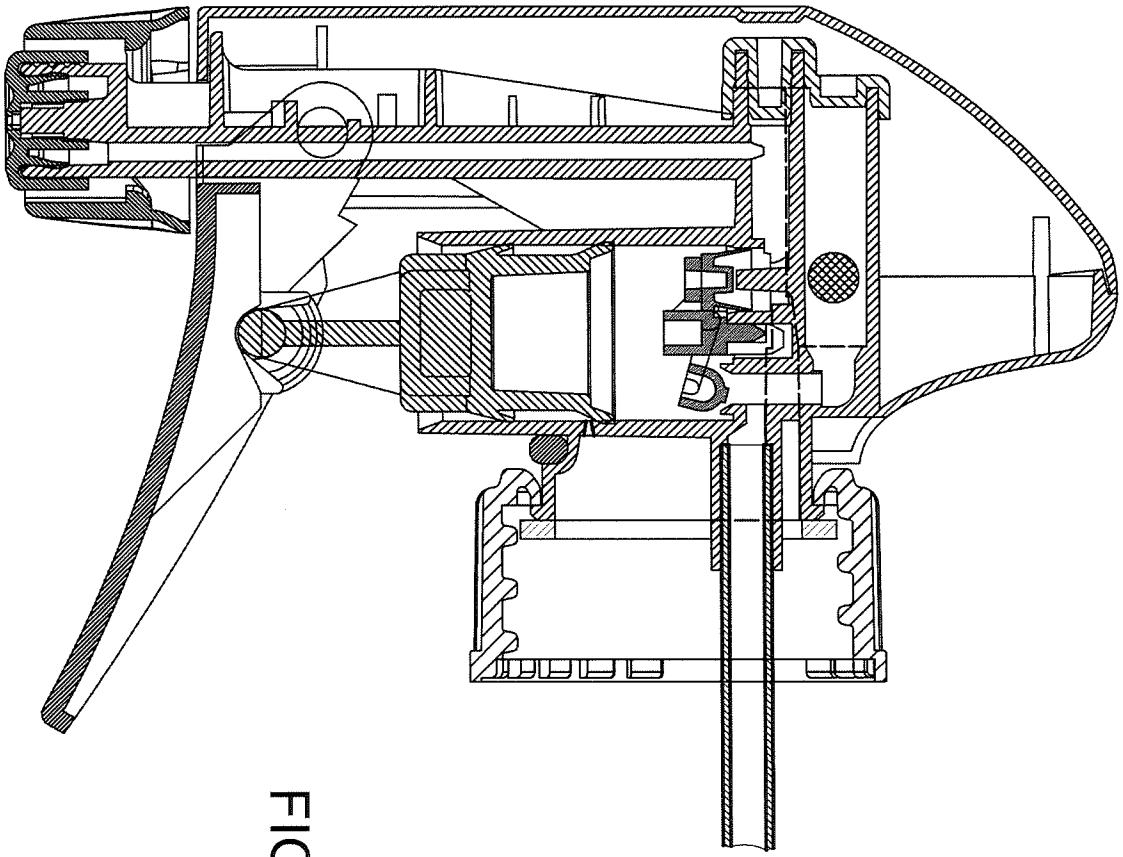
FIG. 1 is a schematic view showing a sprayer according to EP 2321063 which does not work when used in horizontal position.

The appended figures show a sprayer structure as described in European patent EP 2321063 with a suction and delivery valve as described in EP 1585602 both in the name of the same applicant to which reference can be made for greater details on operation of the sprayer.

The sprayer according to the invention, designated as a whole with reference numeral 10, comprises a body 11 closed by a covering cap 12.

A fixing ferrule 15, having an inner thread suitable to engage with an outer thread of the mouth of a container (not shown), suitable for containing a liquid such as, for example, household cleaning liquids, is rotatably mounted at a base of the body 11. Of course, fixing of the sprayer on the container can also take place in a different manner, for example by means of a bayonet coupling.

The body 11 of the sprayer is substantially L-shaped and ends in a spray nozzle 16 with an opening from which the liquid is dispensed.

A trigger lever 17, hinged at one end 18 to the body 11 and in an intermediate portion 19 to the stem 20 of a plunger 21, slidable in a chamber 22 of a pump body 23, is provided for operating the sprayer. A hole for entry of the liquid 24, in communication with the inside of the container through a dip tube 25, and an outlet hole 26, in communication with the spray nozzle 16, through a vertical duct 27 and a horizontal duct 28, are formed in the rear wall of the chamber 22.

The aforesaid liquid inlet and outlet holes 24 and 26 are shut off respectively by a dome portion 31 and a frustoconical tang 32 of a one-way suction and delivery valve 30.

Operation of the one-way valve 30, described better in the aforementioned patent EP 1585602 is fairly intuitive.

On pressing the trigger lever 17, the liquid in the chamber 22 of the pump exerts pressure against the valve 30, deforming the frustoconical tang 32 and then exiting through the outlet hole 26 to travel towards the spray nozzle 16.

When the trigger lever 17 is released and returns the resting position through the action of elastic means not described, the plunger 21 creates a vacuum in the chamber 22, freeing the inlet hole 24, as shown in FIG. 1, causing the liquid sucked from the container to flow into the chamber 22.

What is described thus far is to be considered known from the aforesaid patent EP 1585602.

In order to make the sprayer thus far described into a sprayer of the USD (Up-Side-Down) type, the European patent EP 2321063 discloses to place behind the pump body 23 a cylindrical chamber 40, integral with the pump body 11 which extends parallel to and in contact with the vertical portion 27 of the liquid outlet duct, leading to the drawbacks previously described which will be further described in detail here below.

Figure 2:
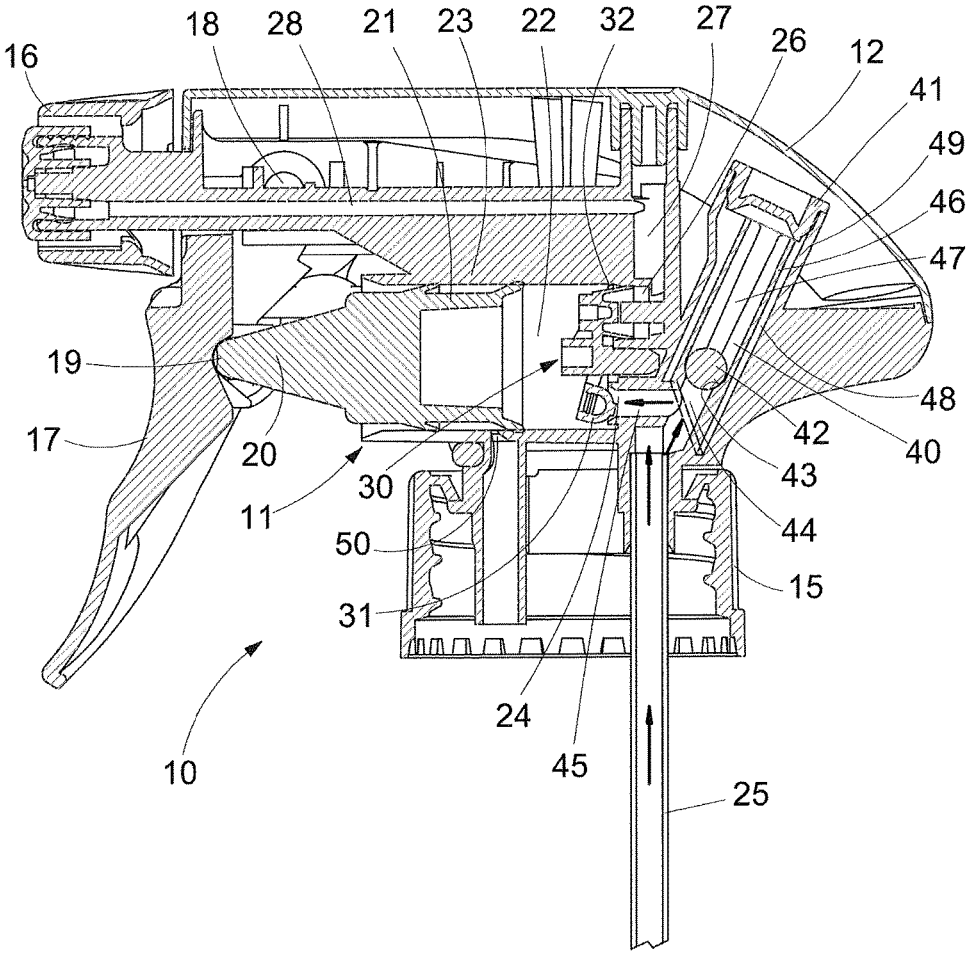
FIG. 2 is a median section view of a sprayer according to the invention in the upright operating condition (Up position)

According to the invention, the cylindrical chamber 40 is disposed slanted backwards with respect to the vertical axis of the sprayer, when it is placed in UP position as shown in FIG. 2 and it is closed at the top by a stopper 41.

Of course other solutions can be provided to close the chamber 40, for example by forming the stopper 41 integrally with the closing cap 12, as provided also in EP 2321063.

In the chamber 40 there is disposed a ball 42, preferably of plastic material, or also of metal or glass, which in normal operating conditions of the sprayer (Up position—FIG. 2) is tightly housed on a conical seat 43, closing a hole 44 provided on the bottom of said chamber, which puts it into communication with the inlet hole 24 of the pump chamber, through a short horizontal duct 45.

In the wall 46 of the chamber 40, above the ball 42, there are provided slots or windows 47 which put the chamber 40 directly into communication with the inside of the liquid container through respective secondary channels 48 which, in the illustrated embodiment, are formed between the chamber 40 and an external chamber 49 which surrounds it.

Operation of the sprayer in the Up and Down position is as follows.

Figure 5:
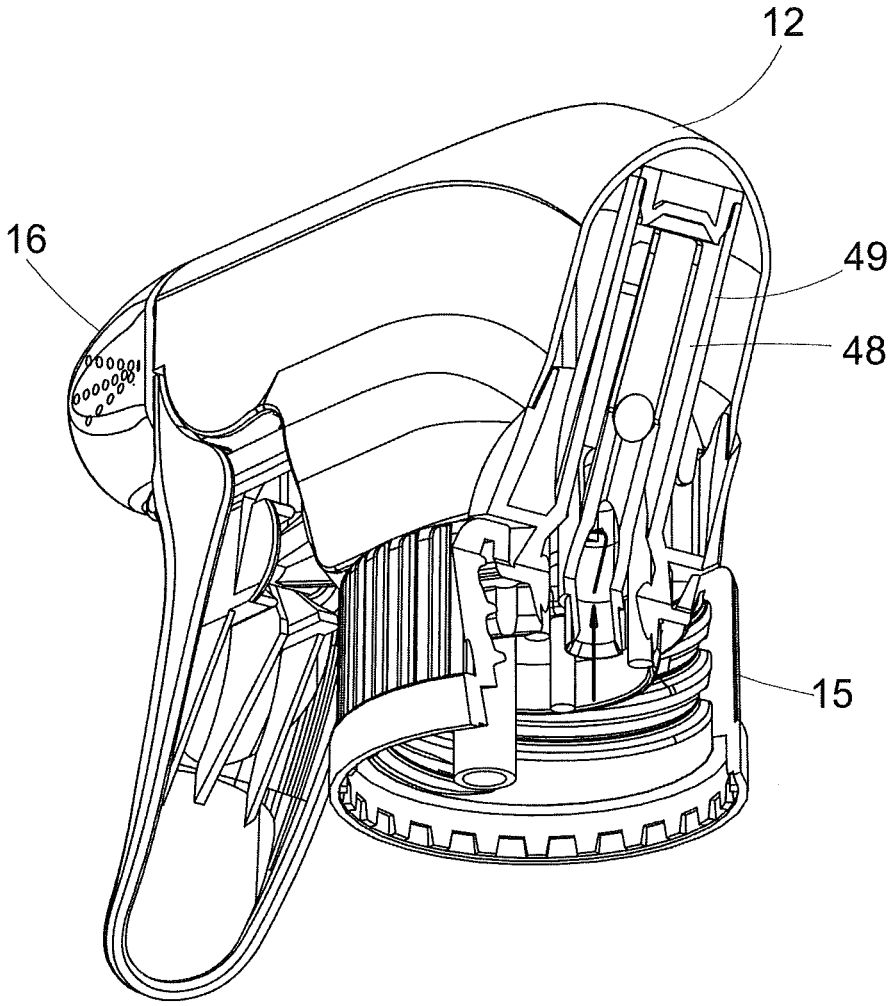
FIGS. 5 and 6 are axonometric views of the sprayer according to the invention, with parts in a cutaway view, shown in the upright and upside-down position, respectively.

In the Up position, the ball 42 is pressed against the conical surface 43 by the pressure difference that is created during the suction step, together with the weight of said ball, thus keeping the hole 44 on the bottom of the chamber 40 closed and allowing normal operation of the sprayer, with suction of the liquid from the inside of the container through the dip tube 25, as shown by the arrows in FIGS. 2 and 5.

Figure 3:
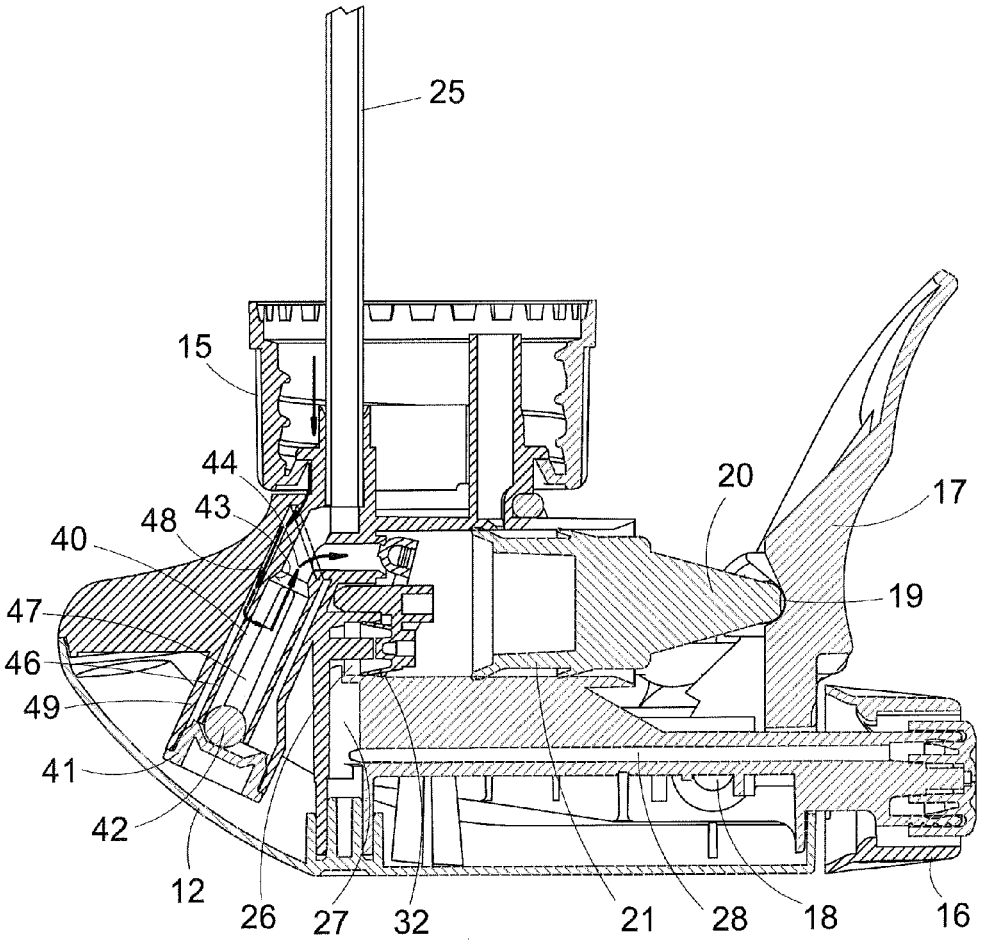
FIG. 3 is view like that of FIG. 2 with the sprayer in the upside-down operating condition (Down position)
Figure 6:
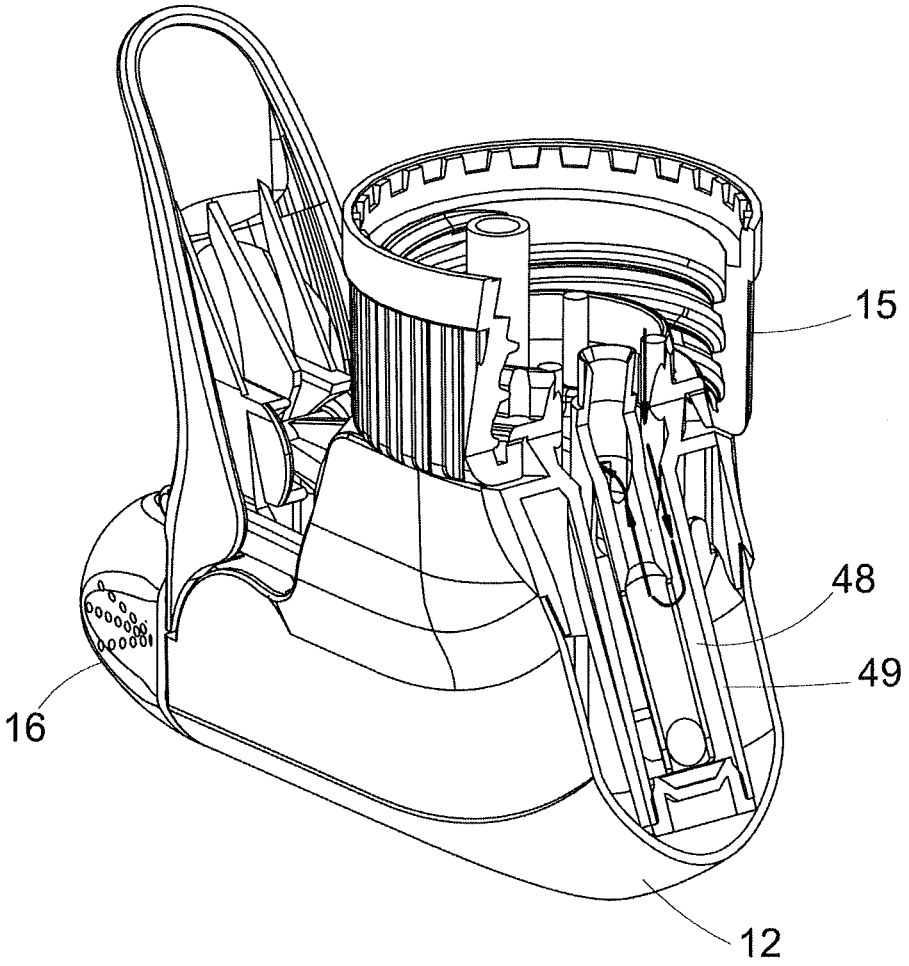

In the Down position the ball 42 falls by gravity to the other end of the chamber 40, where the stopper 41 is provided, freeing the hole 44 and putting the slots 47 into communication with the inlet hole 24 of the pump through the horizontal duct 45, as shown by the arrows in FIGS. 3 and 6.

In this position the chamber 40 is flooded with the liquid that enters through the slots 47 and is then sucked by vacuum into the chamber 22 of the pump following operation of the trigger lever 17 during the return step of the plunger 21, through the effect of elastic means not described.

When the sprayer is brought back to the normal operating condition (Up position), the liquid contained in the USD chamber 40 falls back into the container through the secondary channels 48, the ball 42 is positioned on the conical seat 43 again and the sprayer can operate normally by sucking the liquid from the container through the dip tube 25.

Since the slots 47 in the wall of the chamber 40 are positioned higher up than the ball 42, the chamber 40 is at atmospheric pressure, which is the same as the pressure inside the container. In fact, in a per se known manner, the pressure inside the container, which is into communication with the chamber 40 through the secondary channels 48 and the slots 47, is restored to atmospheric pressure at each operation of the trigger lever 17, through an air hole 50 which is situated at the base of the pump body 23 housing the plunger 21. The hole 50 puts the inside of the container into communication with the outside only when the trigger lever 17 is pressed.

Figure 4:
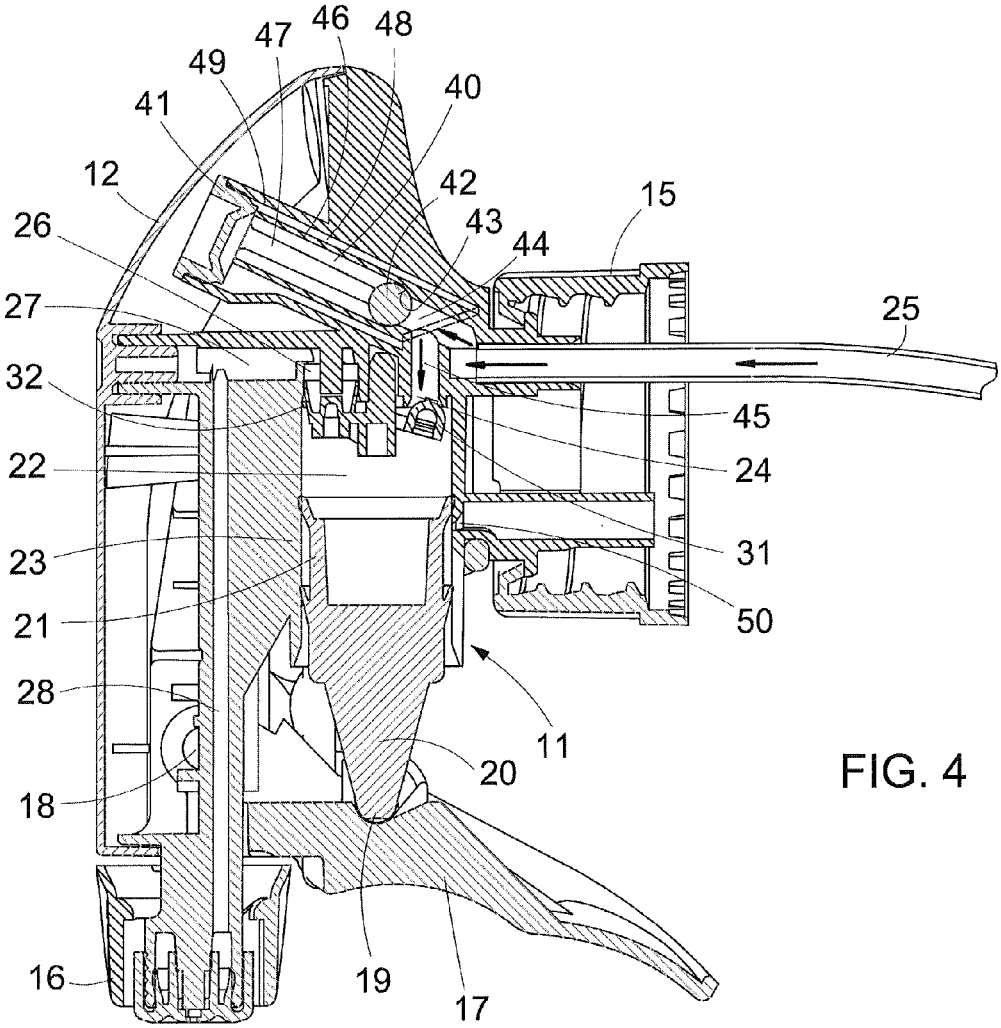
FIG. 4 is view like that of FIG. 2 with the sprayer in the horizontal operating condition.

The slant of the chamber 40 with respect to the vertical axis of the sprayer ensures that when it is disposed in horizontal position to clean for example the surface of a table, as shown in FIG. 4, the ball 42 is disposed by gravity against the conical surface 43 keeping the hole 44 on the bottom of the chamber 40 tightly closed and allowing a normal operation of the sprayer as in UP position, with a suction of the liquid from the inside of the container through the dip tube 25.

The slant of the chamber 40 with respect to the vertical axis can change from 10° to 45°. At angles greater than 45°, problems for normal operation in vertical position could occur.

It has been observed that the ideal trade-off position is that corresponding to about 25°.

From the above, there are apparent advantages of the sprayer with USD function according to the invention, which can be used in horizontal position in contrast with the analogous sprayer according to EP 2321063 which when it is disposed in horizontal position as shown in FIG. 1, provokes a displacement of the ball 42 from its seat and, not closing tightly the hole 44, does not create the depression required to draw the liquid from the container through the dip tube 25.

As stated, the ball 42 is preferably of plastic material, essentially like the other components of the sprayer, so as to allow complete recycling thereof.

Of course the invention is not limited to the particular embodiments previously described and illustrated in the appended drawings, but numerous modifications of detail within the reach of a person skilled in the art can be made thereto without thereby departing from the scope of the invention as set forth in the appended claims.

The invention claimed is:

1. A sprayer comprising:

a body provided with a base that can be applied to the mouth of a container for liquid and a delivery nozzle from which the liquid is sprayed, a pumping chamber being formed in said body, which is in communication with the inside of the container through an inlet hole and a dip tube, and with the delivery nozzle through an outlet hole and a duct having a substantially vertical portion disposed rearward of the pumping chamber and a substantially horizontal portion disposed above the pumping chamber;

a trigger lever hinged to the body of the sprayer and to the stem of a plunger tightly slidable in said pumping chamber;

a one-way suction and delivery valve cooperating with said inlet hole and said outlet hole to control suction of the liquid from the container and delivery of the liquid towards the delivery nozzle following operation of said trigger lever;

an Upside-down (USD) device that allows operation of the sprayer in an upright (Up) position and in an upside-down (Down) position;

said USD device comprising a chamber, closed at the top and integral with said body, disposed rearward of said pumping chamber, and having at least one hole that puts it into communication with the pumping chamber through said inlet hole, and at least one slot that puts it into communication directly with the inside of the container, means being provided to close said hole when the sprayer is in the Up position and to free it when it is in the Down position, allowing the liquid to flow from the inside of the container to the pumping chamber through said slots, wherein said chamber is slanted backwards with respect to the vertical axis of the sprayer, and wherein said at least one slot is into communication with the inside of the liquid container through respective secondary channels which are formed between the chamber and an external chamber which surrounds it.

2. The sprayer according to claim 1, wherein said chamber has a slant angle ranging from 10° to 45° with respect to the vertical axis of the sprayer.

3. The sprayer according to claim 2, wherein said chamber has a slant of about 25° with respect to the vertical axis of the sprayer.

4. A sprayer according to claim 1, wherein said chamber is substantially cylindrical.

5. A sprayer according to claim 1, wherein said hole is provided at the bottom of said chamber and said closing means comprise a ball housed in a conical seat, above said hole, said at least one slot being provided in the wall of the chamber above said conical seat of the ball.

6. A sprayer according to claim 5, wherein said hole provided at the bottom of the chamber communicates with the inlet hole to the pumping chamber through a short horizontal duct into which said dip tube opens.

7. A sprayer according to claim 5, wherein said ball is made of a material selected from the group consisting of plastic, metal, and glass.

8. A sprayer according to claim 1, wherein said chamber is closed at the top by a stopper.

9. A sprayer system, comprising:

a container having a mouth;

a body, comprising:

a pumping chamber;

an inlet hole in the body in fluid communication with the pumping chamber;

an outlet hole in the body in fluid communication with the pumping chamber;

an outlet duct in fluid communication with the outlet hole, comprising:

a substantially vertical portion rearward the pumping chamber; and a substantially horizontal portion above the pumping chamber;

a chamber disposed rearward of the pumping chamber and slanted away from the pumping chamber, comprising:

at least one hole; and at least one slot in fluid communication with an interior of the container;

an external chamber surrounding the chamber; and at least one secondary channel between the chamber and the external chamber;

a plunger positioned in the pumping chamber and slidable therein;

a trigger lever hinged to the body and connected to the plunger;

a one-way suction and delivery valve including a first portion cooperating with the inlet hole and a second portion cooperating with the outlet hole;

a chamber valve cooperating with the at least one hole in the chamber, the chamber valve closing the at least one hole when the sprayer system is in a substantially vertical position; and a base in communication with the body and attaching the body to the container.

10. The sprayer system of claim 9, wherein the chamber valve comprises a ball valve.

11. The sprayer system of claim 9, wherein the chamber valve comprises a ball valve with a ball made of a material selected from the group consisting of plastic, glass, and metal.

12. The sprayer system of claim 9, wherein the at least one hole is adjacent the inlet hole.

13. The sprayer system of claim 9, wherein the body further comprises a horizontal duct between the at least one hole and the inlet hole.

14. The sprayer system of claim 9, wherein the chamber further comprises an open end opposite the at least one hole.

15. The sprayer system of claim 14, further comprising a stopper seated in the open end of the chamber.

* * * * *